US005399070A

United States Patent [19]

Alizaden

[11] Patent Number: 5,399,070

[45] Date of Patent: Mar. 21, 1995

[54] FAN HUB

[75] Inventor: Ahmad Alizaden, Indianapolis, Ind.

[73] Assignee: Valeo Thermique Moteur, Le Mesnil Saint Denis, France

[21] Appl. No.: 918,414

[22] Filed: Jul. 22, 1992

[51] Int. Cl.[6] ..... F04D 29/32

[52] U.S. Cl. ..... 416/189; 416/229 R; 416/241 A; 416/244 R

[58] Field of Search ..... 416/169 A, 189, 204 R, 416/244 R, 238, 229 R, 241 A

[56] References Cited

U.S. PATENT DOCUMENTS

| | | | |
|---|---|---|---|
| 4,358,245 | 11/1982 | Gray . | |
| 4,548,548 | 10/1985 | Gray, III . | |
| 4,569,631 | 2/1986 | Gray, III . | |
| 4,569,632 | 2/1986 | Gray, III . | |
| 4,915,588 | 4/1990 | Brackett | 416/189 |

FOREIGN PATENT DOCUMENTS

| | | | |
|---|---|---|---|
| 2281042 | 3/1976 | France | 416/169 A |
| 2011588 | 9/1970 | Germany | 416/244 R |
| 2339773 | 2/1975 | Germany | 416/244 R |
| 2449596 | 4/1976 | Germany | 416/169 A |
| 3223284 | 12/1983 | Germany | 416/204 R |
| 146007 | 11/1979 | Japan | 416/244 R |
| 2178798 | 7/1986 | United Kingdom . | |
| 447525 | 6/1975 | U.S.S.R. | 416/241 A |

*Primary Examiner*—Edward K. Look
*Assistant Examiner*—James A. Larson
*Attorney, Agent, or Firm*—Morgan & Finnegan

[57] ABSTRACT

A fan hub is disclosed which has a hub insert for securing a shaft against relative rotation in a secure manner. The hub insert can be manufactured simply through injection molding the hub to a non-circular hub insert so that the plastic flows around the hub insert to hold the insert securely within the shell. The central aperture of the hub has inner and outer coaxial cylinders forming an annular space that accommodates the front plate of a motor. Radial, curved vanes on and conforming to the inner surface of the hub also are provided for engine cooling and on the other side of the hub, a shallow, depressed region reduces undesirable turbulence.

8 Claims, 11 Drawing Sheets

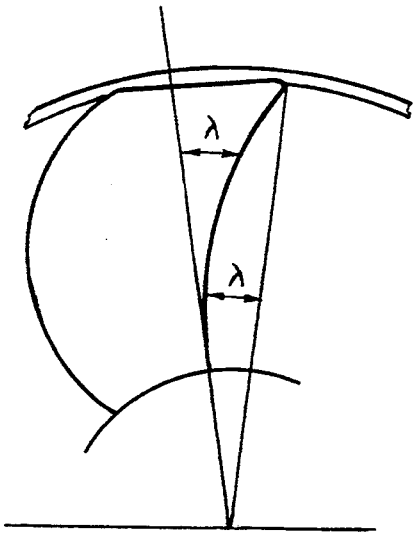
FIG. 4a
FIG. 4b
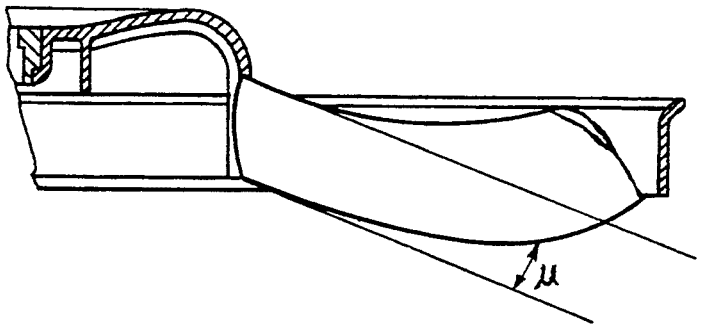
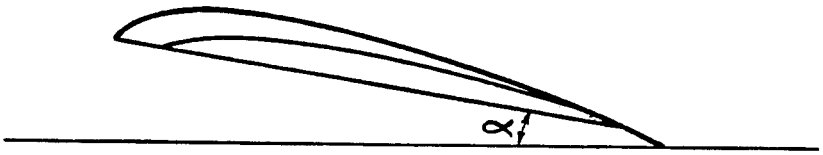
FIG. 4c

FAN HUB

FIELD OF THE INVENTION

The present invention relates to a fan hub, and particularly to a hub for an axial flow fan, for example a fan designed to cool air flowing through a heat exchange system in a vehicle.

BACKGROUND OF THE INVENTION

Such axial flow fans are generally provided with a plurality of blades, each of which is secured at its root to a hub that is driven by a rotating shaft and from which the blade extends radially outwardly. The blades can be spaced around the hub in a symmetrical or non-symmetrical fashion. Axial flow fans are known having blades of various designs. Thus, the blades can be provided with a tangential sweep either in the forward or rearward direction, with variations in pitch angle to suit particular applications. Furthermore, it is known to secure the blade tips to an outer circular band which encloses the blades and is generally centered on the axis of rotation of the fan.

When used in a vehicular application, the fan can be arranged either to blow air through a heat exchange system if the heat exchange system is on the high-pressure (downstream) side of the fan or draw air through the heat exchange system if the heat exchange system is on the low-pressure (upstream) side of the fan. Such fans can be made from moulded plastics or from sheet metal or a combination of the two.

Reference is made to the following documents which describe fans designed particularly for vehicular cooling applications. U.S. Pat. No. 4,358,245, U.S. Pat. No. 4,569,631 and U.S. Pat. No. 4,569,632 disclose a fan of the general type with which the present invention is concerned. In each case, the fan hub comprises a cylindrical hub section providing an aperture centrally of the hub section for receiving a motor shaft by means of which the hub can be rotated. In U.S. Pat. No. 4,548,548, a motor is mounted to a separate housing which is then located within the hub section. GB-A-2178798 also describes a hub having a conventional cylindrical section with an aperture for receiving a shaft.

A first object of the present invention is to provide a fan hub capable of securely locating a shaft to reduce the play between the shaft and the hub and thus to resist relative rotation between the shaft and the hub.

A second object of the present invention is to provide a fan hub which can be manufactured simply.

A third object of the present invention (at least in the preferred embodiment) is to provide a hub in which a motor front plate is protected from dust and moisture.

A fourth object of the present invention (at least in the preferred embodiment) is to reduce the vortex along the surface of the hub and to create less turbulence within the body of the fan.

SUMMARY OF THE INVENTION

According to the present invention there is provided a fan hub comprising an outer shell defining a central aperture, and a hub insert located in the central aperture and held against relative rotation with respect to the hub shell, wherein the hub insert defines an inner surface for holding a shaft against relative rotation with respect to the hub insert.

Preferably the inner surface of the hub insert is non-circular in cross-section to receive a correspondingly shaped non-circular shaft.

To provide a secure mechanical lock between the hub shell and the hub insert, the hub insert can be provided with a plurality of protrusions on its outer surface which serve to locate and grip the hub shell. The hub can thus be manufactured in a single step by an injection moulding process in which the hub insert is inserted into a mould and plastics material is injected into the mould so that it flows around the hub insert and between the protrusions in its outer surface. When the plastics material has set, the hub insert is thus securely held within the hub shell. Rotation between the hub insert and the hub shell is thereby securely resisted.

In the preferred embodiment, the central aperture of the hub shell is defined by an inner cylinder and the hub shell is provided with an outer cylinder coaxial with the inner cylinder to define an annular space between the inner and outer cylinders, which annular space is suited to accommodate a front plate of a motor. Thus, dust and moisture are prevented from reaching the motor.

To assist in cooling the motor, the hub shell can be provided on its inner side with a plurality of radially extending curved vanes conforming to the surface of the hub shell.

The hub shell can be substantially bowl-shaped, that is it can have a shallow, depressed region in the area of the central aperture.

In the preferred embodiment, the shallow, depressed region is flanked by a substantially straight-angled annular region leading to a substantially flat annular region which then curves round into an outer cylindrical surface of the hub. This shape of the hub shell reduces undesirable turbulence in the region of the hub.

For a better understanding of the present invention and to show how the same may be carried into effect, reference will now be made by way of example to the accompanying drawings.

BRIEF DESCRIPTION OF THE DRAWINGS

FIGS. 4*a*, 4*b* and 4*c* illustrate diagrammatically the sweep, dihedral and pitch respectively of a blade;

DESCRIPTION OF THE PREFERRED EMBODIMENT

Figure 1:
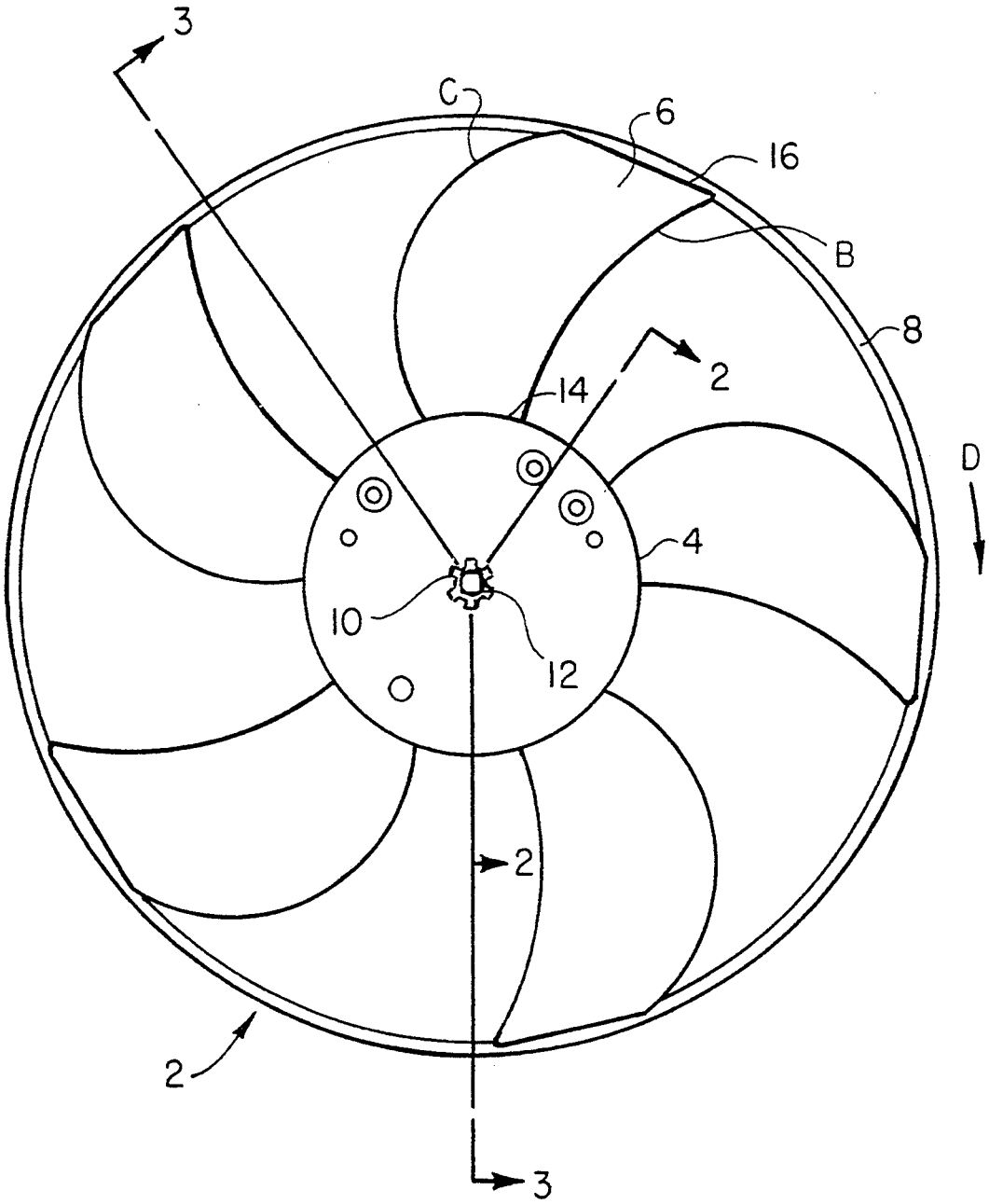
FIG. 1 is a plan view of a fan seen from the front.

FIG. 1 shows in plan view a fan 2 which includes a centrally located cylindrical hub 4 with a plurality (five as illustrated) of blades 6 extending outwardly therefrom to a cylindrical outer rim or band 8.

The hub 4 carries at its centre a hub insert 10 which defines an aperture 12 for accepting a shaft which mounts the fan for rotation around its central axis. The outer band 8 encloses the blades and is generally centered on the axis of rotation of the fan 2. Each blade 6 extends from a root region 14 secured to the hub 4 to an outer (or tip) region 16 secured to the inner surface of the band 8. The tip region 16 of the blades 6 are joined to the band over the full width of the blades and not at a single point or over a narrow connecting line. This increases the strength of the structure.

Figure 10:
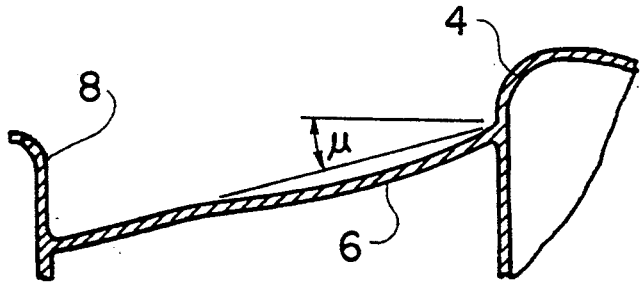
FIG. 10 is a section taken through a blade illustrating the change in dihedral along the span of the blade.

The outer band 8 of the fan adds structural strength to the fan by supporting the blades at their tip and also serves to hold air on the working surface of the blades. The band 8 is of uniform thickness but has a frontmost section 8*a* which is curved to form a funnelling effect, as shown in FIG. 10. This rounding of the band 8 reduces losses due to vortices in the gap between the fan and a shroud surrounding the fan. The band 8 furthermore provides a uniform flow passage for air flow passing through the fan and decreases unwanted variations in the dihedral angle $\mu$ (FIG. 4*b*) and the pitch angle $\alpha$ (FIG. 4*c*) of the blade.

Figure 3:
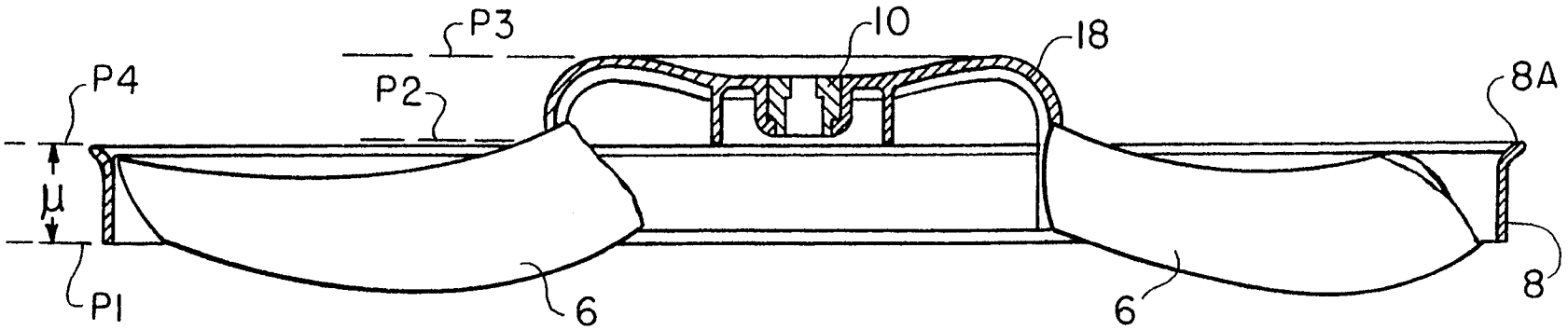
FIG. 3 is a view which is part-section taken through the fan and part perspective view to show the attachment of the blades to the hub (line III—III in FIG. 1)
Figure 3A:
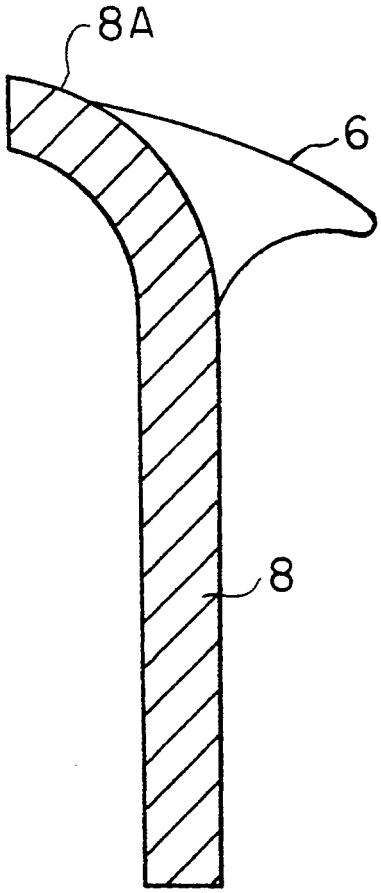
FIG. 3*a* is a view of the tip of a blade secured to the outer annular band.

The blades 6 are shaped so that they are secured to the band 8 with the leading edge B tangential to the frontmost curved section 8*a*. This can be seen in FIGS. 3 and 3*a*.

In use in a vehicular application for engine cooling, the fan can be positioned in front of or behind an engine cooling heat exchanger system comprising for example a radiator, condenser and oil cooler. The fan can be arranged so that air is either blown through the heat exchanger system if the heat exchanger is on the high pressure (downstream) side of the fan, or drawn through the heat exchanger system, if the exchanger is on the low pressure (upstream) side of the fan. The fan 2 is preferably used in conjunction with a shroud that extends between the radiator and the outer edge of the fan. The shroud serves to prevent the recirculation of air around the outer edge of the fan from the high pressure region at the downstream side of the fan to the low pressure region at the opposite side of the fan adjacent the radiator. The shroud can be any suitable structure which blocks this recirculation flow. One known structure is funnel-like as shown for example in U.S. Pat. No. 4,358,245.

Figure 5:
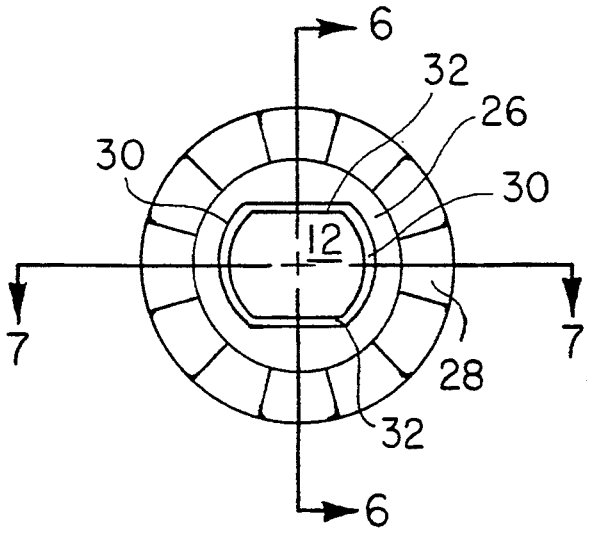
FIG. 5 is a plan view of a hub insert.
Figure 7:
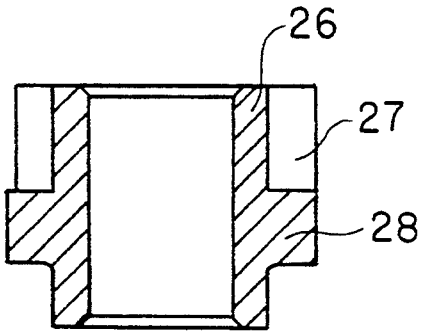
FIG. 7 is a section through FIG. 5 along the line VII—VII.
Figure 6:
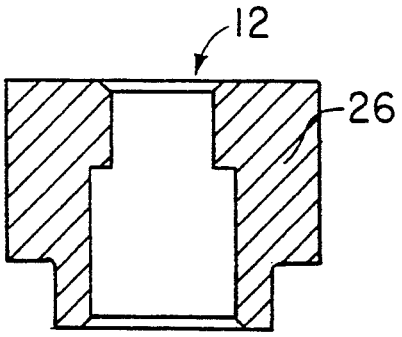
FIG. 6 is a section through FIG. 5 along the line VI—VI.

Reference will first be made to the design of the hub having regard to FIGS. 2 and 3. The hub comprises a plastics moulded body section 18 which defines an outer cylindrical ring 20 and an inner cylindrical ring 22. The inner and outer rings define between them an annular space 21. The inner cylindrical ring 22 has an internal annular ledge 24 provided for supporting a hub insert 10 as described in more detail hereinafter. The hub insert 10 is shown in more detail in FIGS. 5 to 7. The insert can be made of a plastics or metal material and comprises a solid walled cylinder 26 provided around its periphery with a plurality of protrusions 28 which form a castellated outer surface. The insert 10 defines an aperture 12 in the form of a flat sided oval, that is having end portions 30 formed by respective arcs of circles and side portions which are linear. The linear side portions 32 assist to hold a shaft inserted into the aperture 12 against rotation with respect to the hub insert 10. The castellated outer surface of the hub insert 10 enables the hub insert to be connected to the plastics moulded section 18 of the hub in a single manufacturing step. That is, a mould defining the plastics moulded body section 18 is provided in which the hub insert 10 is placed. Plastics material is injected into the mould in a known injection moulding process and enters the regions 27 (FIG. 7) in the surface of the hub insert between the protrusions 28. Thus, a secure mechanical connection is provided between the hub insert 10 and the plastics moulded section 18. The hub insert 10 provides a better fit and thus reduces the play between a shaft inserted into the aperture 12 and the insert 10. This thus helps preserve the fan balance when rotating and reduces the drift of the fan from true axial rotation.

The annular space 21 can accommodate the front plate of an electrical motor provided to drive the shaft and thus protect the motor from the intrusion of moisture and dust.

The fan hub 4 is designed to approximate a bowl shape which is more rounded than the straight cylindrical hubs of the prior art. More particularly, the hub outer surface has a central shallow depressed region 15 flanked by a substantially straight angled annular region 50. This annular region leads to a substantially flat annular region 52 which then curves into a radius 54 which passes into an outer cylindrical surface of the hub. The elimination of a sharp angle at the front part of the hub reduces losses due to vortices forming at the hub surface. This so-called "vortex shedding" causes undesirable turbulence in the flow in the region of the hub.

The minimum width of the hub in the axial direction is at least equal to the blade width at the root of the blade 6. The distance between planes P2,P1 passing through the base of the outer ring 20 and of the outer band 8 respectively and perpendicular to the axis of rotation may vary up to 50% of the axial extent, a, of the band 8. A plane P3 passing through the front of the hub and perpendicular to the axis of rotation may coincide with a plane P4 passing through the front of the band.

Figure 2:
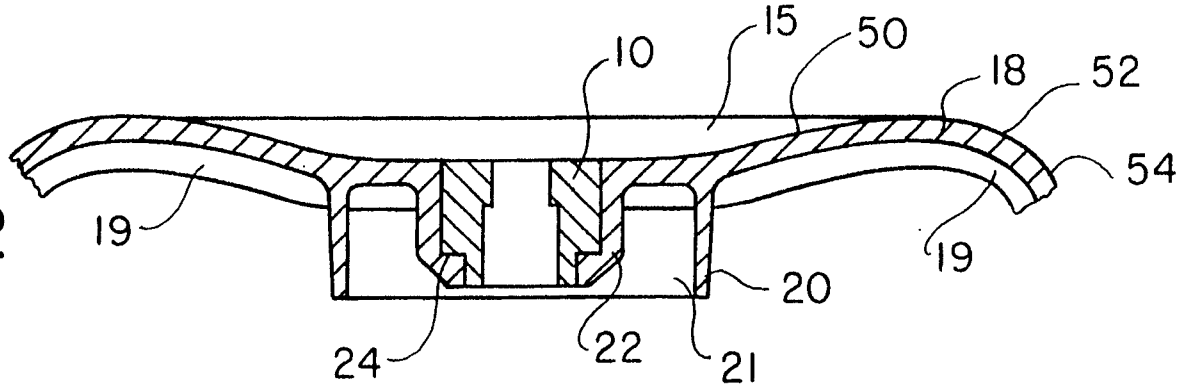
FIG. 2 is a cross-section taken through the hub of the fan along line II—II in FIG. 1.

The hub moulded section 18 is provided with a plurality of radially extending vanes, two of which can be seen in FIG. 2 designated by reference numeral 19. As can be seen from FIG. 2, and more clearly in FIG. 3, the vanes 19 are curved with the moulded plastics section 18 and serve to guide flow recirculating in the rear part of the hub in an effective manner to cool the electric motor by dissipating heat generated thereby. The vanes 19 extend inwardly towards the inner cylindrical ring 22 and thus also provide structural support for the hub body and hub insert.

Referring again to FIG. 1, the blades of the fan will now be described. As shown in FIG. 1, each blade is forwardly skewed in that the medial line of the blade (which is the line obtained by joining the points that are circumferentially equidistant from the leading edge B and the trailing edge C of the blade) is curved in a direction (root to tip) corresponding to the direction D of rotation of the fan 2. The leading and trailing edges B,C are similarly curved. This skew is referred to herein as the tangential sweep of the blade and is indicated diagrammatically by the angle $\lambda$ in FIG. 4*a*. Furthermore, each blade is secured to the hub at a dihedral angle which is illustrated diagrammatically by angle $\mu$ in FIG. 4*b*. The dihedral angle $\mu$ is the angle between a tangent to the blade surface and the plane containing the axis of rotation. Furthermore, the blade is pitched so that the leading and trailing edges B and C are not in the same plane.

Figure 14:
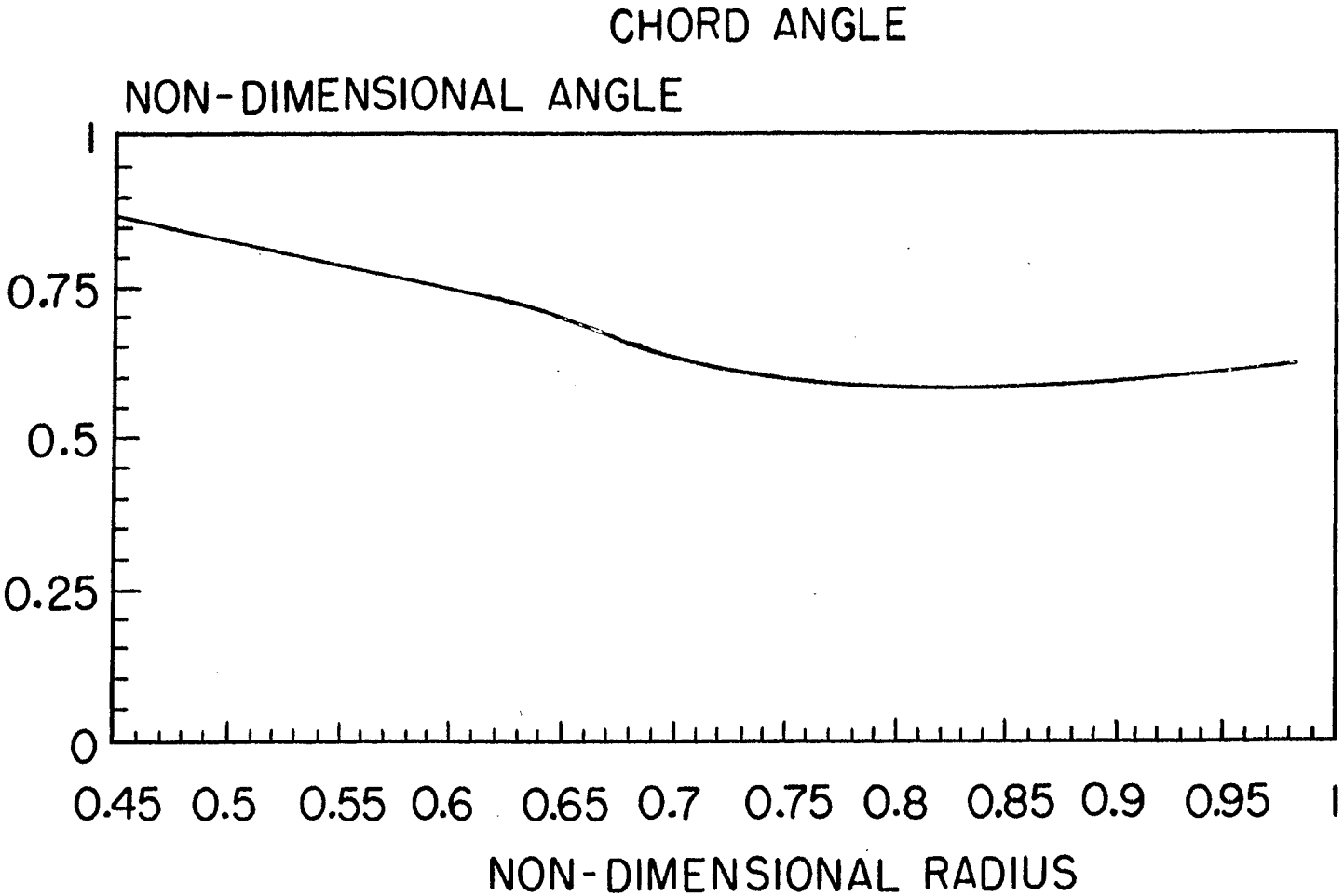
FIG. 14 is a graph showing the variation of chord angle with respect to blade span.

The pitch angle $\alpha$ is shown in FIG. 4c. The variation of pitch (or chord) angle with the radius of the blade moving fron root to tip is shown in FIG. 14.

Figure 8:
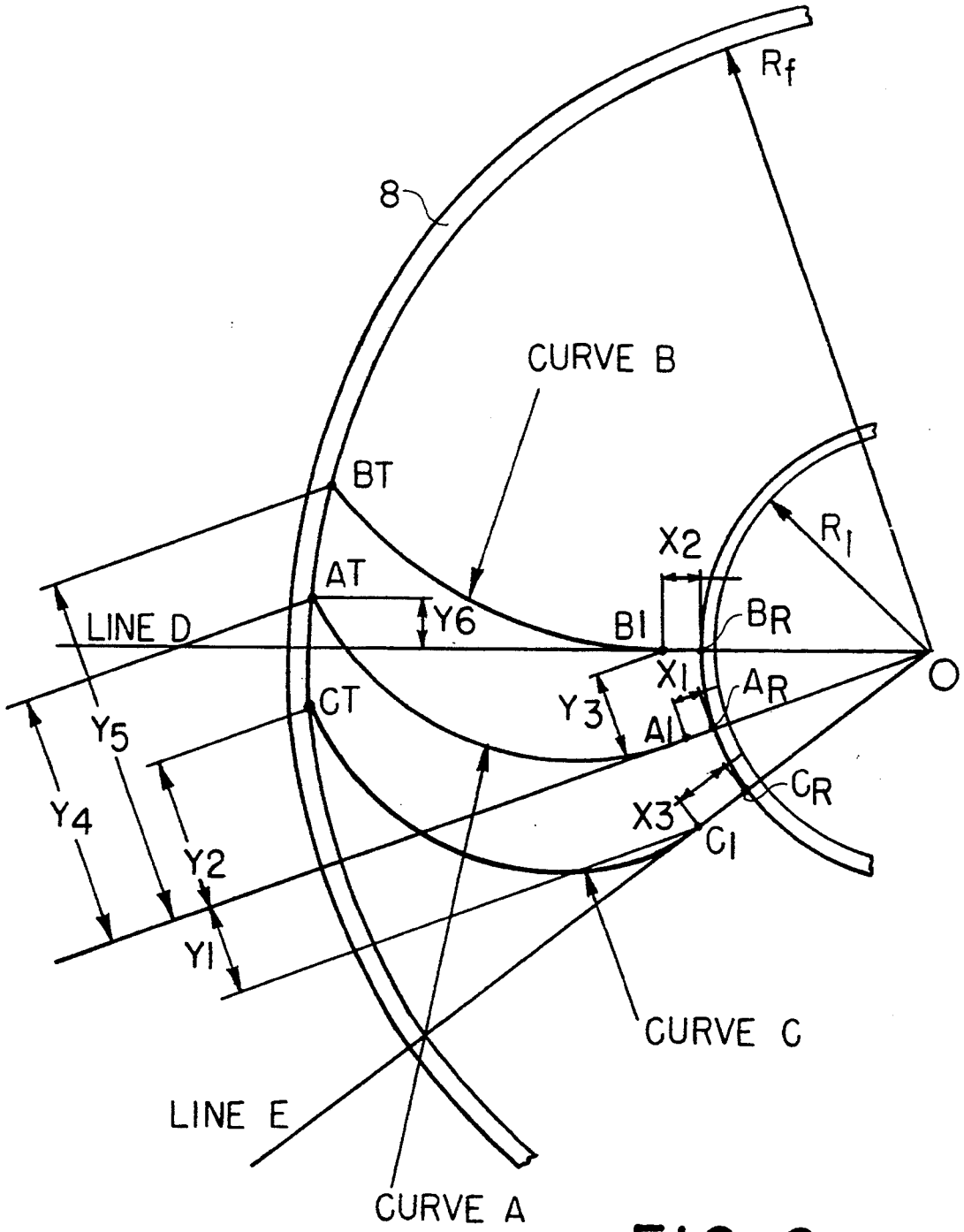
FIGS. 8 and 9 are axial plan elevations of a blade.

Reference will now be made to FIG. 8 to describe the tangential sweep $\lambda$ of the blade. In FIG. 8, the fan origin is indicated as O and three lines are shown emanating radially from the origin, line D, line x and line E. The leading edge of the blade, curve B, has a first part BR-BI of length x2 which extends tangentially to the line D. The medial line, curve A, similarly has a first part AR-AI of length x1 tangentially to the line x and the curve C defining the trailing edge has a similar part CR-CI of length x3 extending tangentially to the radial line E. The lengths x1, x2 and x3 are preferably between 5% and 10% of the curve length.

As can be seen in FIG. 8, the curved portions BR-BI and CR-CI do not extend exactly tangentially to their respective radial lines D and E over the whole of the length x2 and x3. However, these portions should be designed to be as close to the tangent as possible, subject to other design constraints. The variation of the portion BR-BI from the tangent can hardly be distinguished in FIG. 8, but the variation of the portion CR-CI is clearer. Thus, it will be understood that the term "tangential" used herein includes within its scope substantially but not necessarily completely tangential portions. As explained earlier, the provision of a linear portion at the root region of the blade increases the strength of the blade at the root portion.

In another embodiment, the points BI,AI and CI are further along their respective curves B and C, and in particular can lie any distance up to 50% of the curve length. In this embodiment, the portions CR-CI and BR-BI are skewed in one direction up to the tangential point CI and the blade then skews in the opposite direction between CI and CT and between BI and BT, CT and BT being the contact points of the blade tip with the outer band 8.

The points AI, BI and CI (defining the lengths x1, x2 and x3) may all be placed on the same circle defined from the fan origin 0 or may be on different circles. The preferred relationship between the values AI, BI and CI is given below with reference to the points of intersection of these curves AT, BT, CT with the outer band 8. Lines are drawn parallel to the radial line x to intersect respectively the points BT, AT, CT, BI and CI. The following distances are measured from the radial line x to these lines as follows:

Y5 to the line intersecting BT
Y4 to the line intersecting AT
Y2 to the line intersecting CT
Y3 to the line intersecting BI
Y1 to the line intersecting CI Preferably the relationship between these values is as follows:

Y2 is greater than or equal to Y1
Y4 is greater than or equal to Y3
Y5 is greater than or equal to Y4
Y6 (the distance between line D and a line running parallel to it intersecting AT) is greater than or equal to 0
Y4 is greater than Y2

However, other relationships between these values may be satisfied depending on the application of the blade, provided that there is always a portion CI, BI of the blade tangential to a radius.

Figure 9:
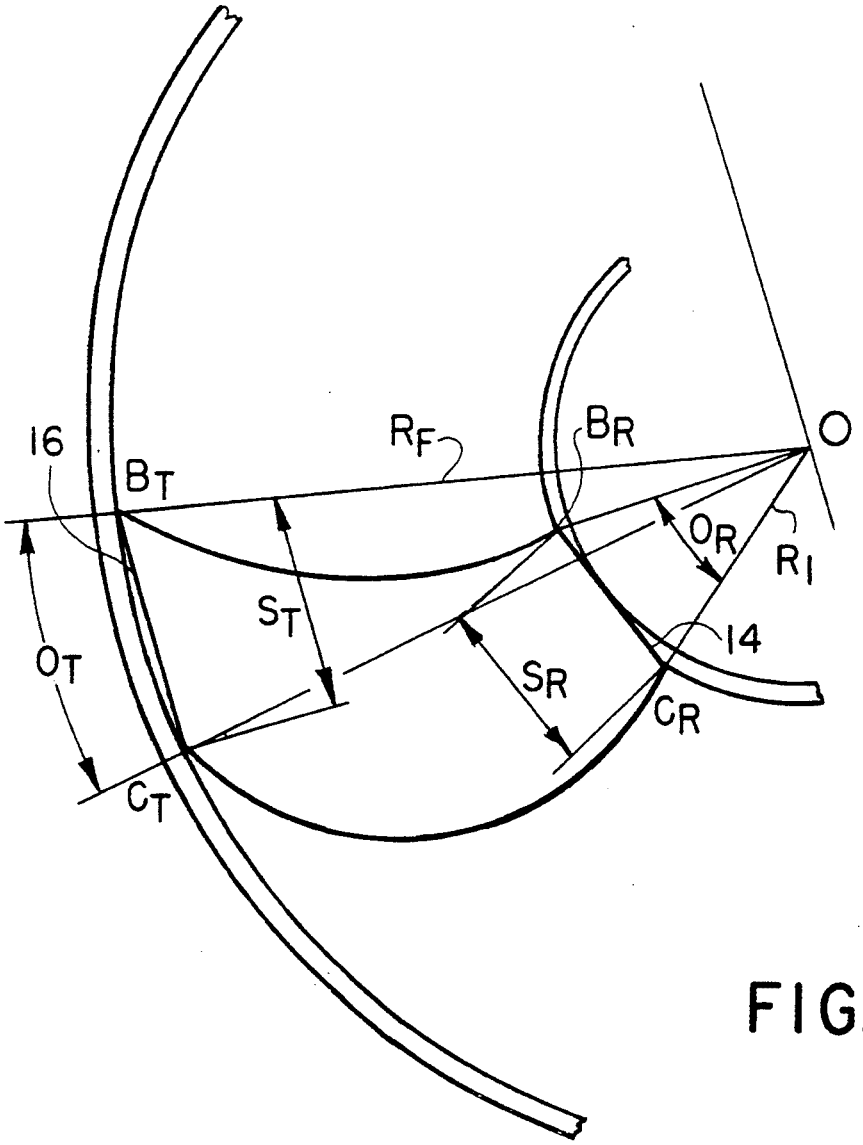

FIG. 9 illustrates the relationship between the chord width projection at the root 14 of the blade and that at the tip 16. Ri is the radius of the hub measured from the fan origin O and $\Theta_R$ is the angle subtended by the points CR and BR (the root points of the trailing and leading edges). The root chord length $S_R$ is Ri $\Theta_R$ where $\Theta_R$ is in radians.

The angle $\Theta_t$ subtended by radii intersecting the points CT,BT defines the tip chord width projection as $S_t = R_f \Theta_t$ where $R_f$ is the outer fan radius. In the illustrated embodiment, $\Theta_R$ is greater than $\Theta_t$ and $S_t$ is greater than or equal to $S_R$.

Figure 12:
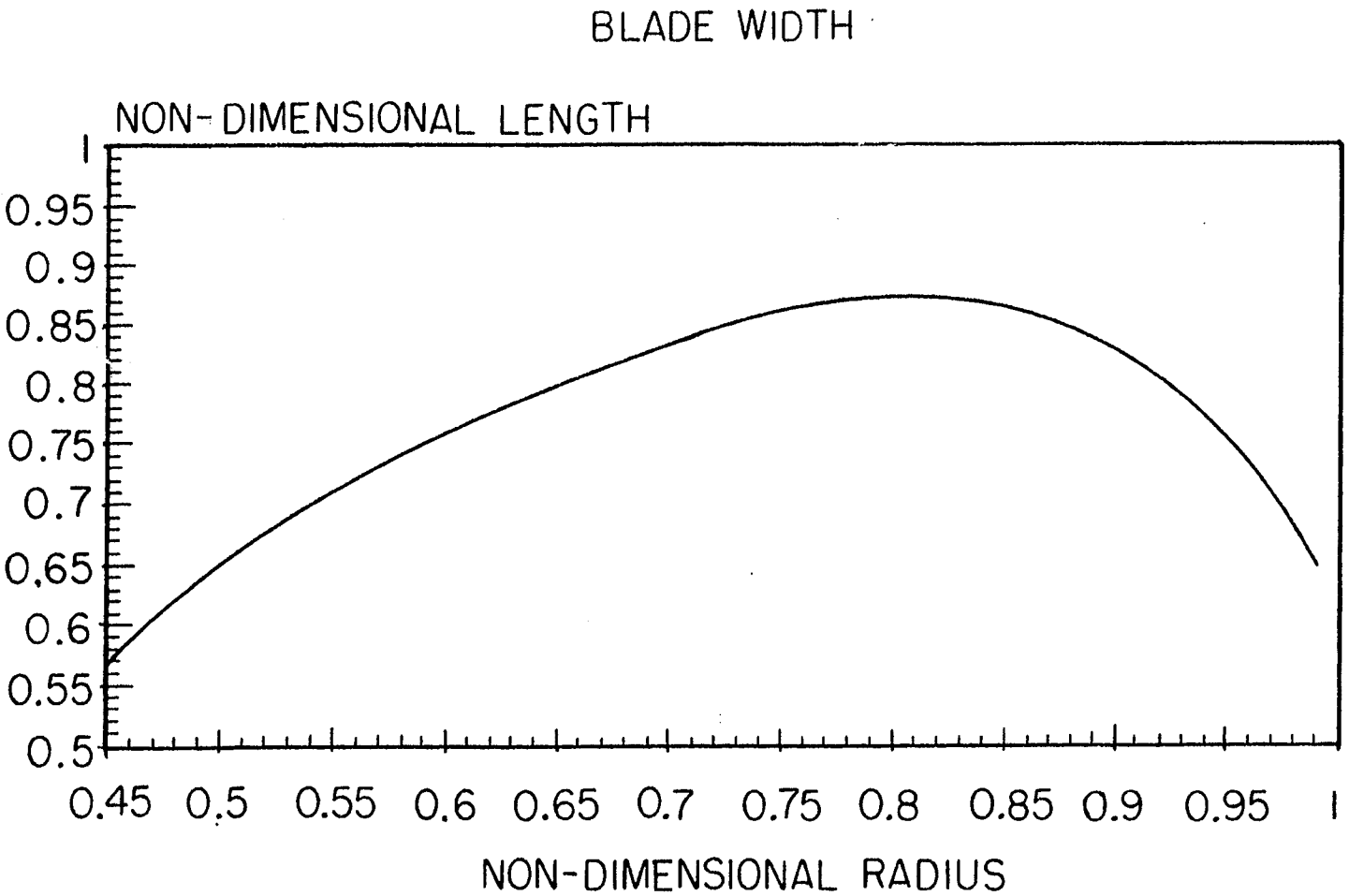
FIG. 12 is a graph showing the variation of blade width with respect to blade span.

The chord width gradually increases from the root of the blade for a distance corresponding to 50–70% of the span of the blade and then decreases continuously for the remaining 50–30% of the span of the blade. The relationship of the chord width with respect to the radius of the fan (the span of the blades) is given in FIG. 12. The variation of the chord angle with respect to the radius of the fan is given in FIG. 14. The projected blade width follows closely the chord width. Thus, projected blade width gradually increases from the root of the blade for a length corresponding to 50–70% of the span of the blade and then decreases continuously for the remaining 50–30% of the span of the blade.

FIG. 10 shows in section the blade 6 and its connection at its root to the hub 4 and at its tip to the band 8. FIGS. 4–6 and 10 clearly shows a variation in the dihedral angle $\mu$ such that the dihedral angle decreases with respect to the radius of the fan along the span of the blade over the first 65–75% of the blade span and then stays constant for the remaining 35–25%. As an alternative to the dihedral angle remaining constant over the remaining 35–25% of the blade span, it could increase slightly over this distance.

Figure 11:
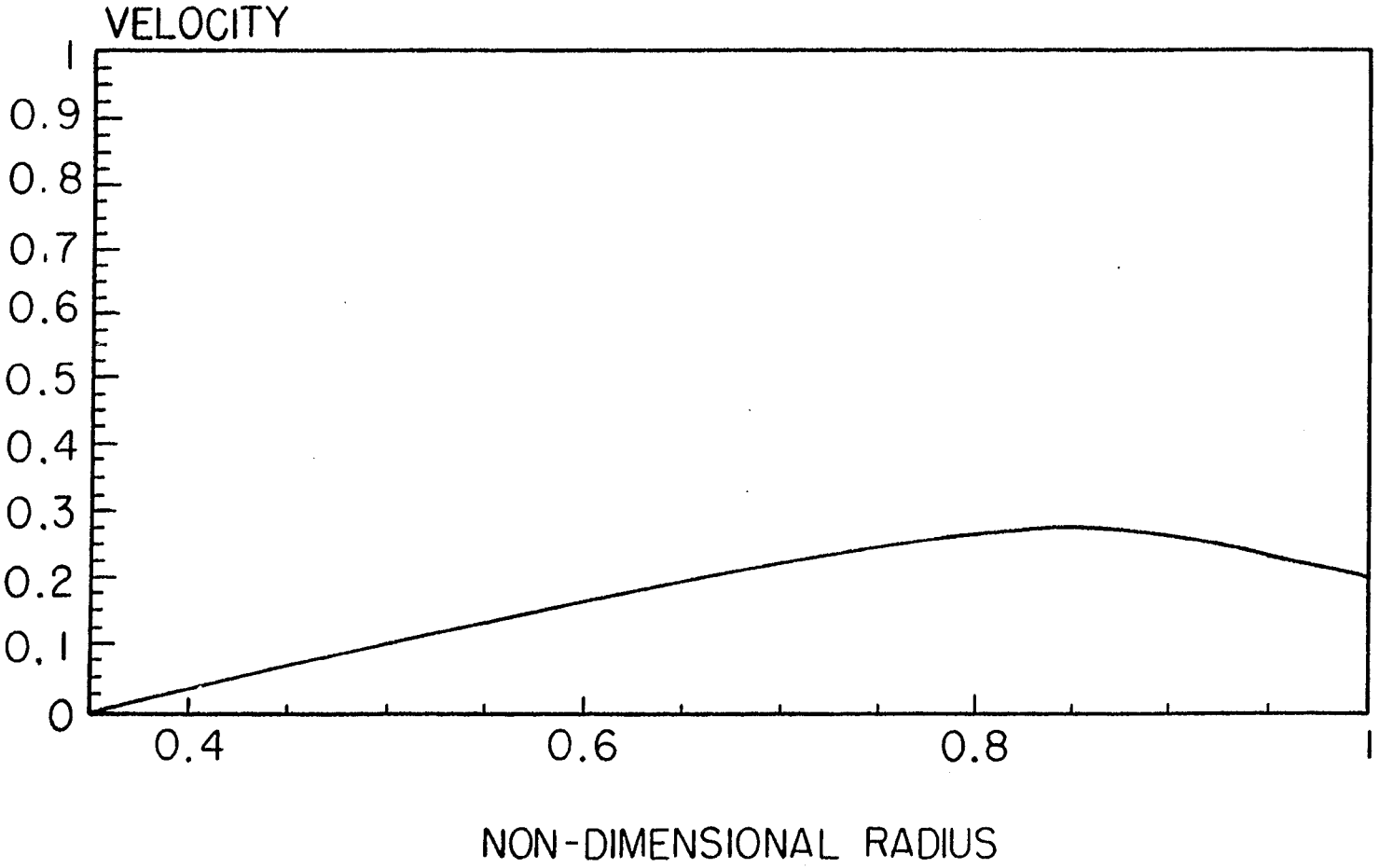
FIG. 11 is a graph showing the variation of velocities along the blade span.

The blade described herein provides a downstream variable axial flow velocity which increases continuously from the hub 4 to the outermost tip 16 of the blade, with the maximum axial velocities occurring over the span of the blade at the outermost 25–35% of the blade. The variation in velocity with respect to radius is shown in FIG. 11. This variation enables the performance efficiency of the fan to be optimised whilst reducing the noise level.

Figure 13:
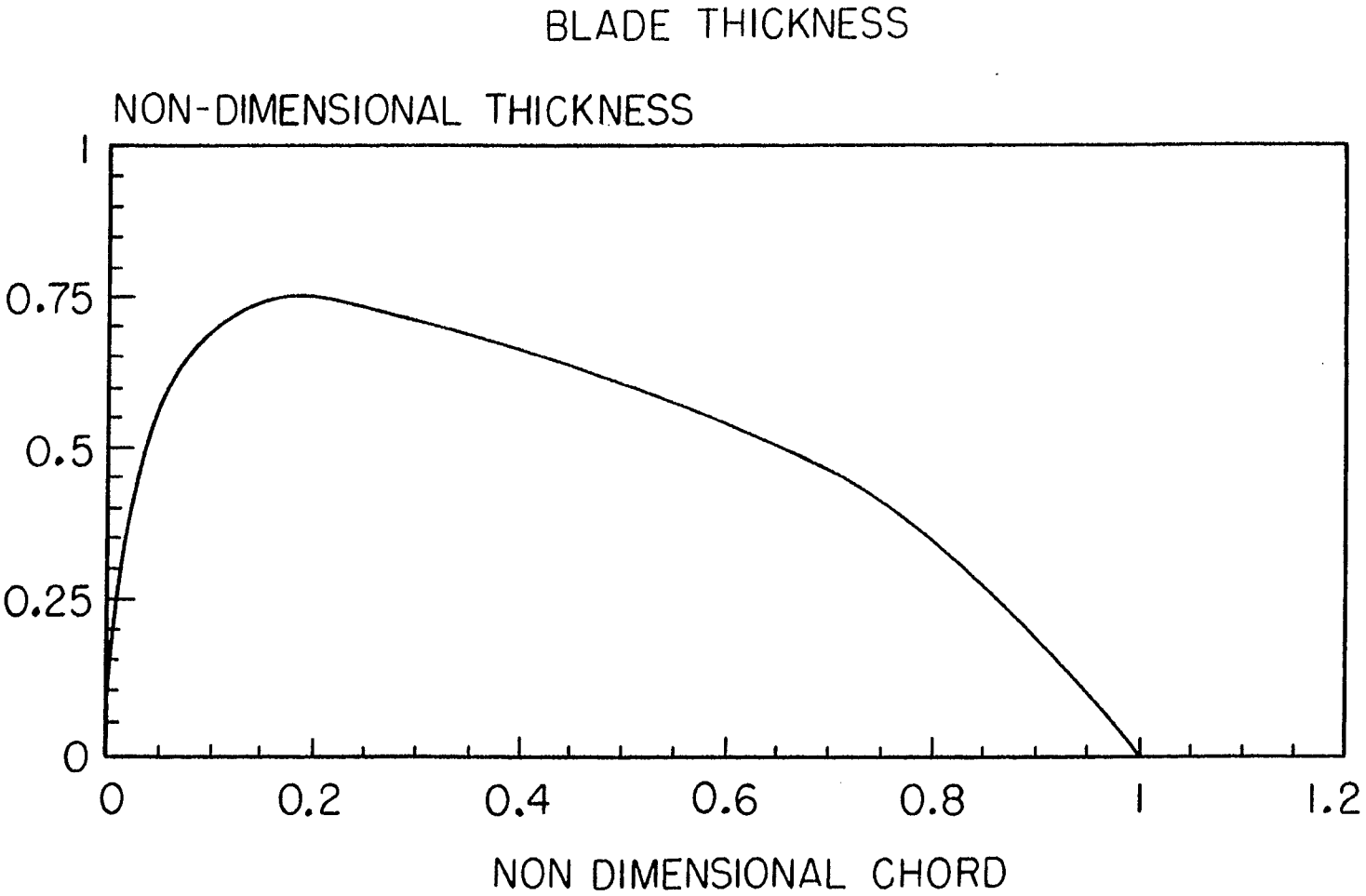
FIG. 13 is a graph showing the variation of blade thickness with respect to blade chord.

The blade thickness decreases spanwise of the blade and also varies across the chord length. FIG. 10 and 13 show the variation of blade thickness across the dihedral plane and across the chord width of the blade. The blade thickness has been calculated to optimally reduce the weight of the blade, aerodynamic (aerobic) losses and noise.

While the preferred embodiment of the present invention has been described, it will be apparent that other variations, alterations or modifications are possible without departing from the main principles of the invention and such modifications, alterations and variations are intended to fall within the scope of the appended claims.

In particular, the fan described herein can be used without an outer band 8. Furthermore, although a preferred method of manufacture is by injection moulding of a plastics section which provides the hub, blades and band integrally, other manufacturing processes are possible using a combination of plastics and metal as known in the art.

What is claimed is:

1. A fan hub comprising an outer shell defining a central aperture, and a hub insert located, and engaged with, in the central aperture, said hub insert having opposite ends and an outer surface, said outer surface being defined by a cylindrical protrusion offset inwardly from said ends of said hub insert, said outer surface being further defined by a plurality of radial protrusions extending from one of said hub insert ends to said cylindrical protrusion, said radial protrusions being separated by regions which define longitudinal grooves, said outer surface having a constant circular cross section between the other of said hub insert ends and said cylindrical protrusion, said central aperture being defined by a surface having a complementary configuration with respect to said outer surface, said outer shell being tightly held between said radial protrusions to resist relative rotation with respect to said hub insert, the engagement between said outer shell and cylindrical protrusion resisting relative axial displacement between said outer shell and hub insert, wherein the hub insert defines an inner surface for holding a shaft against relative rotation with respect to the hub insert.

2. A fan hub according to claim 1, wherein the inner surface of the hub insert is non-circular in cross-section to receive a correspondingly shaped non-circular shaft.

3. A fan hub as claimed in claim 1, wherein the central aperture of the hub shell is defined by an inwardly extending inner cylinder and the hub shell is provided with an inwardly extending outer cylinder coaxial with the inner cylinder to define an annular space between the inner and outer cylinders, which annular space is suited to accommodate a front plate of a motor.

4. A fan hub as claimed in claim 1, wherein said hub shell is provided on its inner surface with a plurality of radially extending vanes conforming to the surface of the hub insert.

5. A fan hub as claimed in claim 1, wherein said hub shell is substantially bowl-shaped with a hollow, depressed region in the area of the central aperture.

6. A fan hub as claimed in claim 5, wherein the central aperture of the hub shell is defined by an inwardly extending inner cylinder and the hub shell is provided with an inwardly extending outer cylinder coaxial with the inner cylinder to define an annular space between the inner and outer cylinders, which annular space is suited to accommodate a front plate of a motor.

7. A fan hub according to claim 1 wherein the outer shell has a shallow, depressed region in the area of the central aperture flanked by a substantially straight-angled annular region leading to a substantially flat annular region which curves round into an outer cylindrical surface of the hub shell.

8. A fan hub according to claim 5 wherein said depressed region in the area of the central aperture is flanked by a substantially straight-angled annular region leading to a substantially flat annular region which curves round into an outer cylindrical surface of the hub shell.

* * * * *